US007549608B2

(12) United States Patent
Godley

(10) Patent No.: US 7,549,608 B2
(45) Date of Patent: Jun. 23, 2009

(54) DETACHABLE LINE MANAGEMENT DEVICE FOR TRACTION KITES

(75) Inventor: Mark Brian Godley, Vancouver (CA)

(73) Assignee: Liquid Sky Kiteboarding Inc., Vancouver, British Columbia (CA)

( * ) Notice: Subject to any disclaimer, the term of this patent is extended or adjusted under 35 U.S.C. 154(b) by 115 days.

(21) Appl. No.: 11/380,060

(22) Filed: Apr. 25, 2006

(65) Prior Publication Data

US 2006/0237593 A1 Oct. 26, 2006

Related U.S. Application Data

(60) Provisional application No. 60/674,436, filed on Apr. 25, 2005.

(51) Int. Cl.
*A63H 27/00* (2006.01)

(52) U.S. Cl. ..... 244/155 A; 244/155 R; 244/153 R

(58) Field of Classification Search ..... 244/155 A, 244/155 R, 153 R
See application file for complete search history.

(56) References Cited

U.S. PATENT DOCUMENTS

| | | | | |
|---|---|---|---|---|
| 5,435,259 | A | 7/1995 | Labrador | |
| 6,257,525 | B1 * | 7/2001 | Matlin et al. | 244/153 R |
| 6,273,369 | B1 * | 8/2001 | Nishimura et al. | 244/155 A |
| 6,877,697 | B2 * | 4/2005 | Bellacera | 244/155 A |
| 2002/0084384 | A1 | 7/2002 | Bellacera | |
| 2002/0088385 | A1 | 7/2002 | Thompson | |
| 2003/0154898 | A1 | 8/2003 | Lagaignoux | |
| 2004/0159747 | A1 | 8/2004 | Runyan | |
| 2004/0182968 | A1 | 9/2004 | Gentry | |
| 2004/0195459 | A1 | 10/2004 | Pouchkarev | |
| 2005/0040291 | A1 | 2/2005 | Hansel | |
| 2005/0133669 | A1 | 6/2005 | Royannais et al. | |
| 2006/0049313 | A1 | 3/2006 | Godley | |
| 2006/0059665 | A1 | 3/2006 | Ponting et al. | |

FOREIGN PATENT DOCUMENTS

| | | | |
|---|---|---|---|
| EP | 1302398 | A2 | 4/2003 |
| JP | 2005/008133 | A | 1/2005 |
| WO | WO 01/52961 | A1 | 7/2001 |
| WO | WO 2004/013711 | A3 | 2/2004 |

OTHER PUBLICATIONS

International Search Report.

* cited by examiner

*Primary Examiner*—Michael R Mansen
*Assistant Examiner*—Valentina Xavier
(74) *Attorney, Agent, or Firm*—Bruce S. Londa; Norris McLaughlin & Marcus, PA

(57) ABSTRACT

A device is provided for managing lines of a kite which device is securable to a control bar of a kite and has a line attachment portion. The line attachment portion having a plurality of kite line retainers for detachably retaining lines of a kite. The device is secured to the control bar by an internally cylindrical sleeve having a longitudinal opening. Opposing portions of the sleeve adjacent the longitudinal opening are biased towards each other, and are elastically flexible to allow insertion of the control bar while frictionally retaining the control bar once inserted. The kite line retainers are formed as a slit in a circumferential direction with respect to the sleeve, which slit is formed to frictionally and removably retain a line inserted therein. In one embodiment, a stem extends radially from the sleeve, the line attachment portion residing at the distal end of the stem, the line attachment portion being formed as a longitudinal member perpendicular to the stem. In an alternate embodiment, the kite line retainers for retaining the lines is formed on an outer surface of the sleeve.

17 Claims, 7 Drawing Sheets

DETACHABLE LINE MANAGEMENT DEVICE FOR TRACTION KITES

This application claims priority under 35 USC 119(e) of U.S. Ser. No. 60/674,436, filed Apr. 25, 2005.

BACKGROUND OF THE INVENTION

Kiteboarding or kitesurfing is becoming a rapidly growing extreme sport for land, water or snow. Commonly used traction kites are foil or inflatable, with a leading edge, where (with reference to FIG. 2) two or three 3 lines 6*a*, 6*b* are attached, and a trailing edge, usually where two lines (control lines) 7*a*, 7*b* are attached. Kites of this type are shown in US 2003/0154898; US 2003/0154898, US 2002/0088385 and US 2002/084384. These lines are between 20 and 30 meters in length and are attached to a control bar 2. The kite pilot uses the control bar to steer the kite and manage the power of the kite through a sheeting system that shortens or lengthens the leading edge lines. The sheeting system is known in the art, and generally consists of a hollow sleeve 10 through which the leading edge lines 6*a*, 6*b* run, and which sleeve can slide up and down along the lines to change the effective length of these lines. The control bar and sheeting system may also have some form of safety device allowing the kite pilot to immediately de-power or detach oneself from the kite and its lines.

For safety and practical reasons of space, it is important that the lines are untangled prior to attaching a power kite to the lines, and it is equally important to make sure the lines are attached to the appropriate places on the kite prior to launching. A crossed or tangled line can result in loss of control and an unbalanced kite that can cause severe injury.

Commonly the kite pilot will wind the lines of the kite around the control bar for storage when not using the kite. Most control bars provide hooks or perpendicular finger extensions 4 at each end for this purpose.

When preparing the kite for launching the lines require careful layout, unwinding and ensuring they are untangled and uncrossed. This can take time and space at the launching area.

SUMMARY OF THE INVENTION

It is therefore an object of the invention to provide a line control device on the control bar of a kite, such that the rolling of the lines with the aid of the device will achieve the following advantages:

The lines will not become crossed over.

The lines can be attached to the kite prior to unwinding the lines from the bar.

The space required for set up is greatly reduced.

The chances of line cross-over or line tangling is reduced.

These objects are achieved by providing a preferably detachable device for managing lines of a kite, which device has a means for securing the device to a control bar of a kite and a line attachment portion of the device, the line attachment portion having a plurality of means for detachably retaining lines of a kite. The means for securing is preferably formed to have an internally cylindrical sleeve having a longitudinal opening. Opposing portions of the sleeve adjacent the longitudinal opening are biased towards each other, and are elastically flexible to allow insertion of the control bar while being sufficiently rigid to frictionally retain the control bar once inserted. The means for detachably retaining lines is preferably formed as a plurality of slits or grooved slots in a circumferential direction with respect to the sleeve, which slit or slot is formed to frictionally and removably retain a line inserted therein. In one embodiment, a stem portion extends radially from the means for securing, the line attachment portion residing at the distal end of said stem, the line attachment portion being formed as a longitudinal member perpendicular to the stem. In a second embodiment, the means for retaining the lines is formed adjacent an outer surface of the sleeve.

DETAILED DESCRIPTION

A preferably detachable device 30 is provided for attachment to the control bar 2. It is also possible that the device is permanently fixed to the bar, or that the features of the device which interact with the lines are provided as an integral part of the bar. However, the detachable version is preferred in order to keep the control bar free of extra structural elements during use of the kite.

Figure 1:
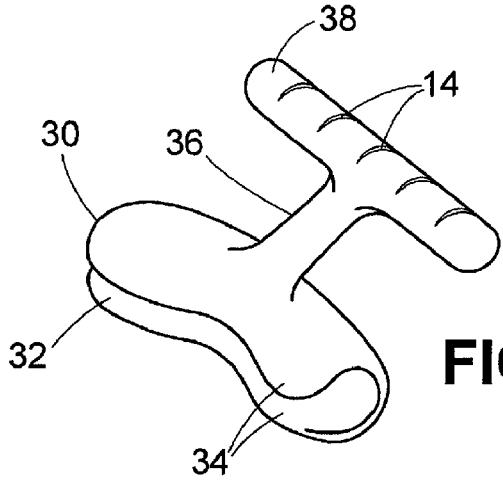
FIG. 1 is a perspective view showing a first embodiment of a device of the invention.
Figure 2:
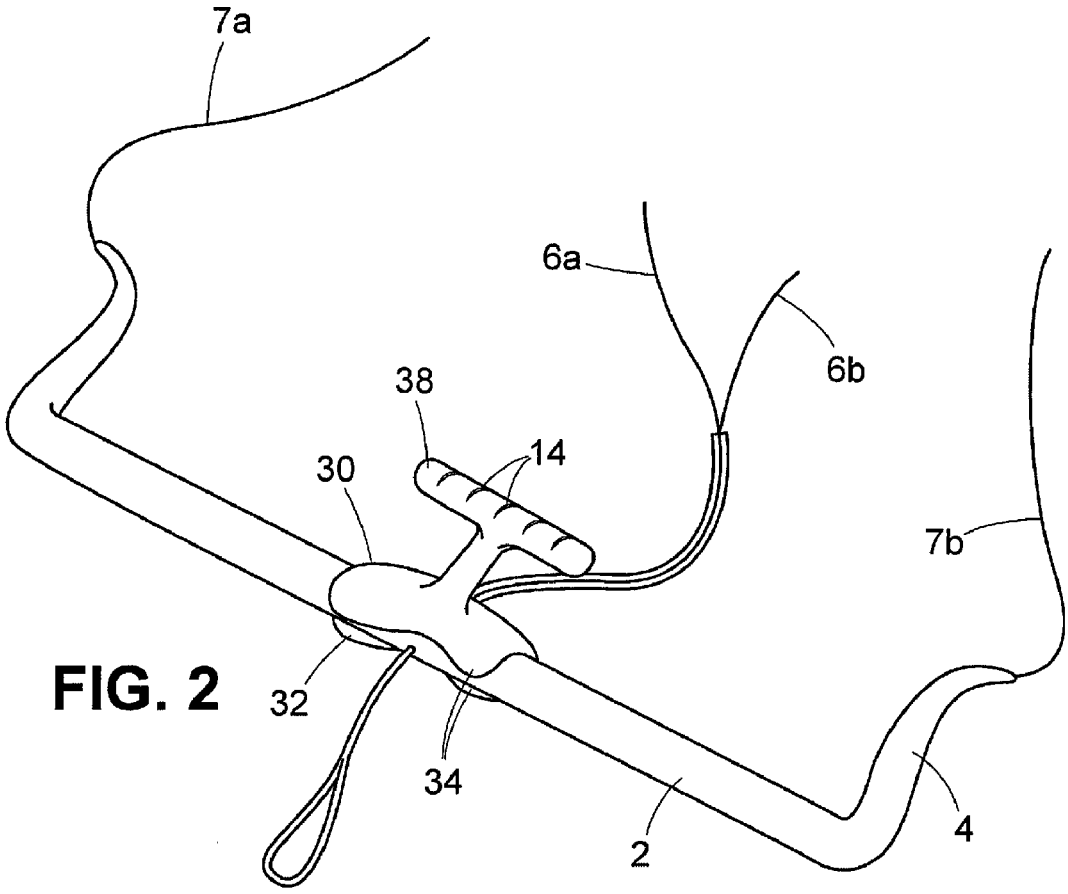
FIG. 2 is a perspective view showing the device of FIG. 1 attached to a control bar.
Figure 3:
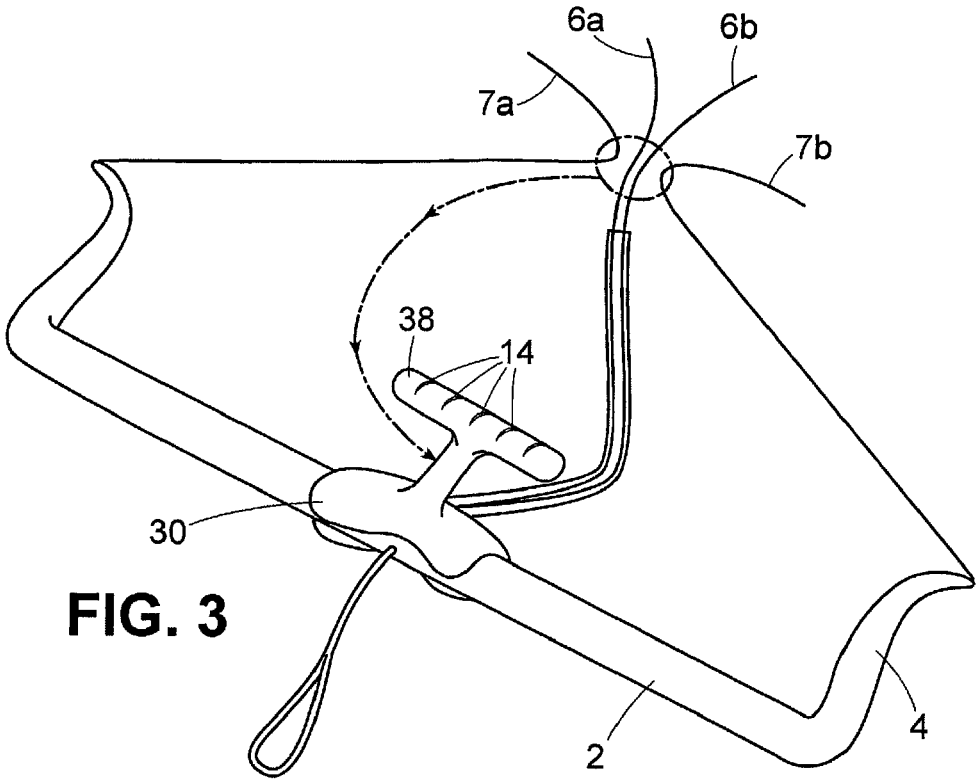
FIG. 3 is a view of FIG. 2 showing kite lines being gathered.

The device 30 is provided with means 32 for releaseably securing the device to a usually cylindrical control rod 2. This may be any means which can accomplish a relatively easy and quick, yet secure, detachable retention of the device on the control bar. In the drawings, an embodiment is shown wherein the securing means 32 is formed as an integral extension of the device 30. The device, or at least the securing means portion, is preferably formed of generally rigid material with elastic properties, such as sheet metal, hard rubber such as Santoprene™ or plastic. The means 32 shown in FIG. 1 is shaped to have an internally cylindrical sleeve with a longitudinal opening running the length of the sleeve. The opposing free ends of the longitudinal opening comprise two opposing portions 34, which may be in the form of fingers, the internal circumference of which are shaped conformingly with the control bar 2. The fingers 34 are formed with a lateral distance between the opposing free ends thereof being less than the diameter of the control bar. In this manner, the fingers, which are biased toward each other, may be fitted onto the control bar by forcing the bar between the two fingers, thus prying them away from each other. As the control bar is pushed in, the fingers snap back toward each other and the cylindrically curved inner surfaces of the fingers grasp the corresponding outer surface of the control bar. It is noted that the inner cylindrical sleeve form of the means 32 need not be cylindrical or conforming along its entire length, but is preferably of such a shape along at least a portion thereof sufficient to grasp and retain the control bar therein. It should be seen that numerous securing means may be employed, such as clips, hooks, straps, hook and loop fasteners, force-fit based on corresponding holes and pegs in the device and the control bar, fingers which are biased toward each other and openable by way of a hinge therebetween so as to form a so-called alligator clip, etc. However, the embodiment described above is preferred because of its ease of application and removal, and universal applicability.

From the securing means 32, a first embodiment (FIGS. 1-5) has a line attachment portion 38 of the device protruding generally perpendicular from the cylindrical axis of the securing means, or stated another way, perpendicular from the control bar when fastened thereon. Thus, a stem portion 36 protrudes from the securing means 32 and ends as a line attachment portion 38. The stem and line attachment portions are shown together as a T-shaped portion. This allows (as described below) for the lines to be wrapped around the stem portion, while the top portion of the 'T' provides a surface for securing the lines. Other structures which accomplish these functions are also possible, as in a generally straight protrusion which has an indented neck portion acting as the stem, with its free end bearing a surface for attaching the lines.

Furthermore, a second embodiment of the device (FIGS. 6-11) is formed with the line attachment portion 38 integral to the securing means 32, preferably formed on the outside surface thereof. This embodiment functions in similar fashion to the first embodiment, with the exception of the ability to use the device as a wrapping aid.

When storing the lines of the kite, the lines (6*a*, 6*b*, 7*a*, 7*b*) of the kite are gathered together by hand (FIG. 3), and wrapped at least once around the stem 32. The retention of the lines at that point then serves as a starting and reference point for further wrapping of the lines for storage.

Figure 4:
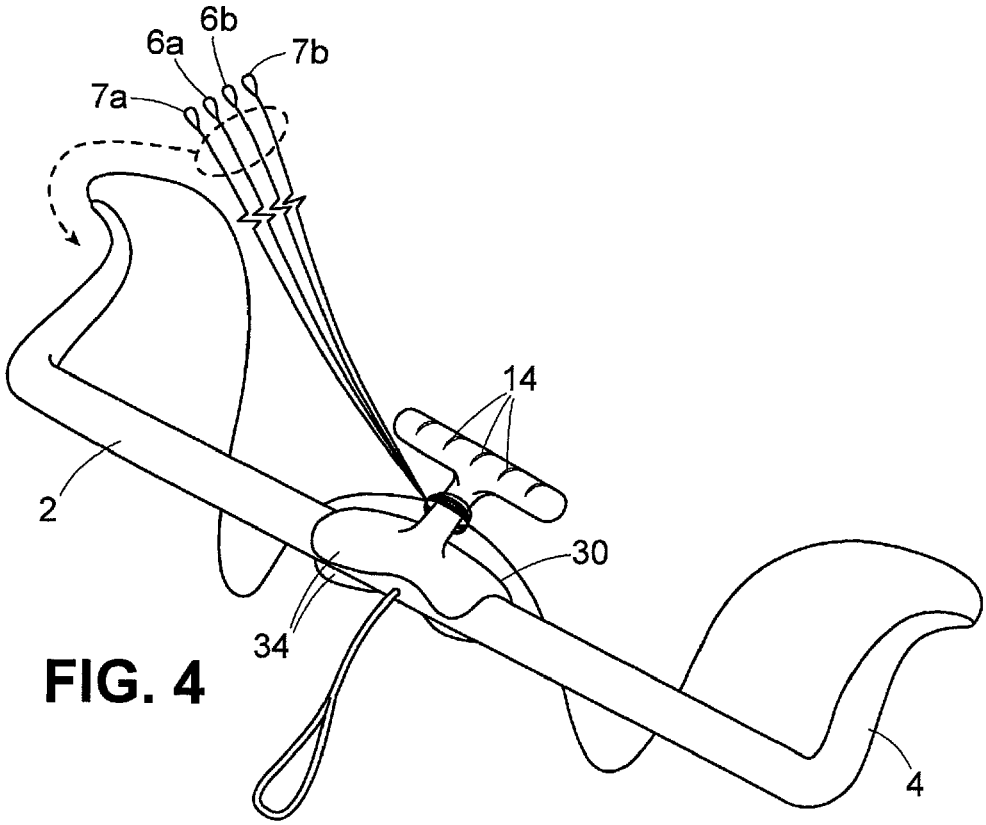
FIG. 4 is a view of FIG. 2 showing kite lines being wrapped around the stem of the device.
Figure 5:
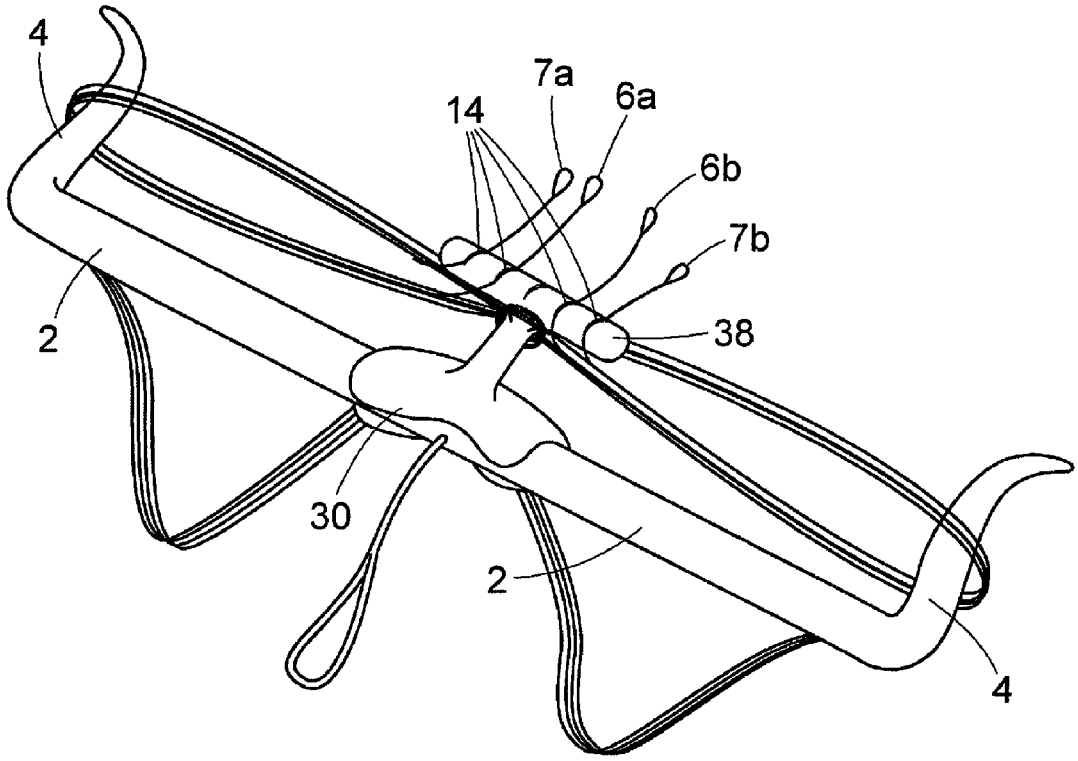
FIG. 5 is a view of FIG. 2 showing kite lines being secured to the device.
Figure 6:
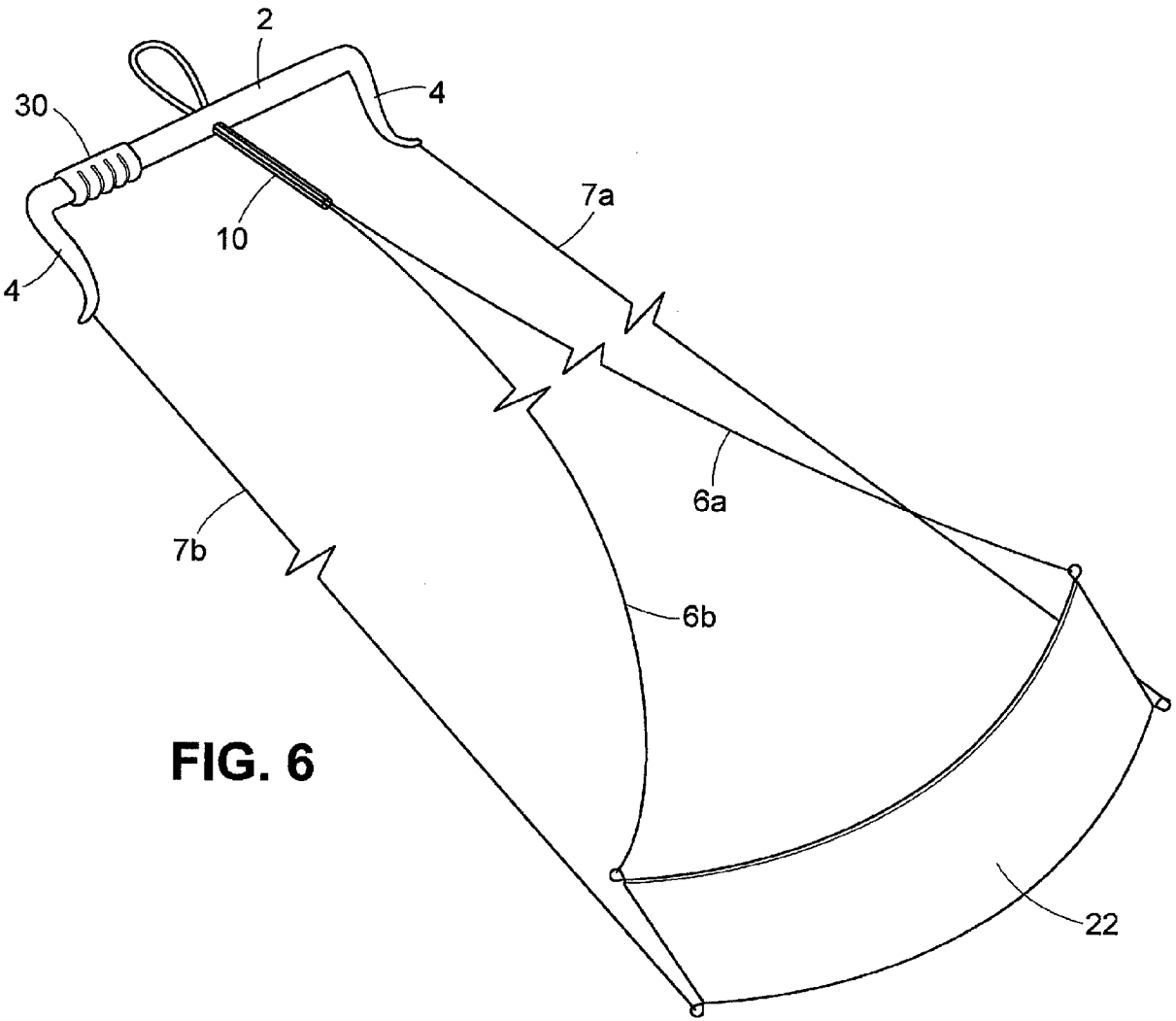
FIG. 6 is a perspective view showing a second embodiment of a device of the invention.

As in FIGS. 4 and 5, the lines are then wrapped, preferably in a figure eight fashion, around the opposing protruding fingers 4 of the control bar. With only a few meters of unwound line remaining, the lines are then separated and secured in their respective slots on the line attachment portion. While other means are possible for securing the lines to the line attachment portion, such as hooks, clips, or the like, slots are the preferred structure.

Figure 8:
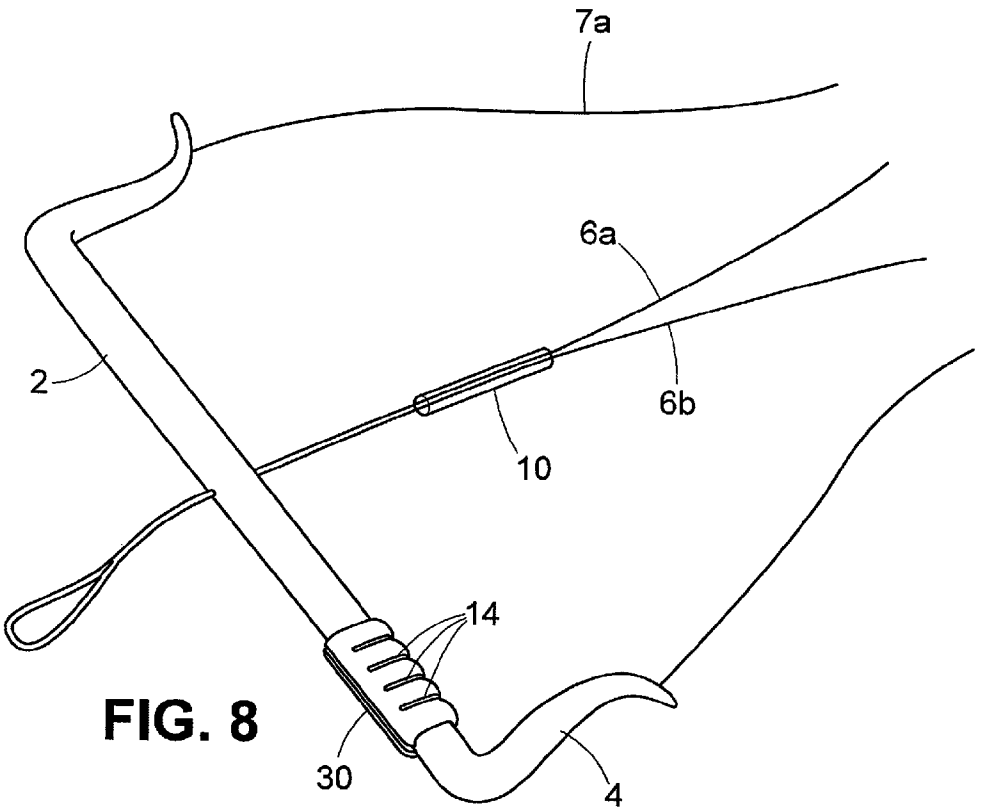
FIG. 8 is a view of FIG. 7 showing kite lines being gathered.
Figure 7:
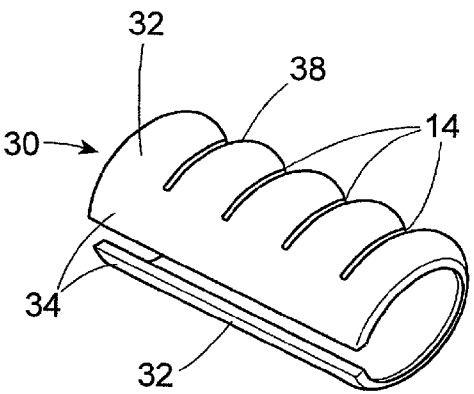
FIG. 7 is perspective view showing the device of FIG. 6 attached to a control bar.
Figure 9:
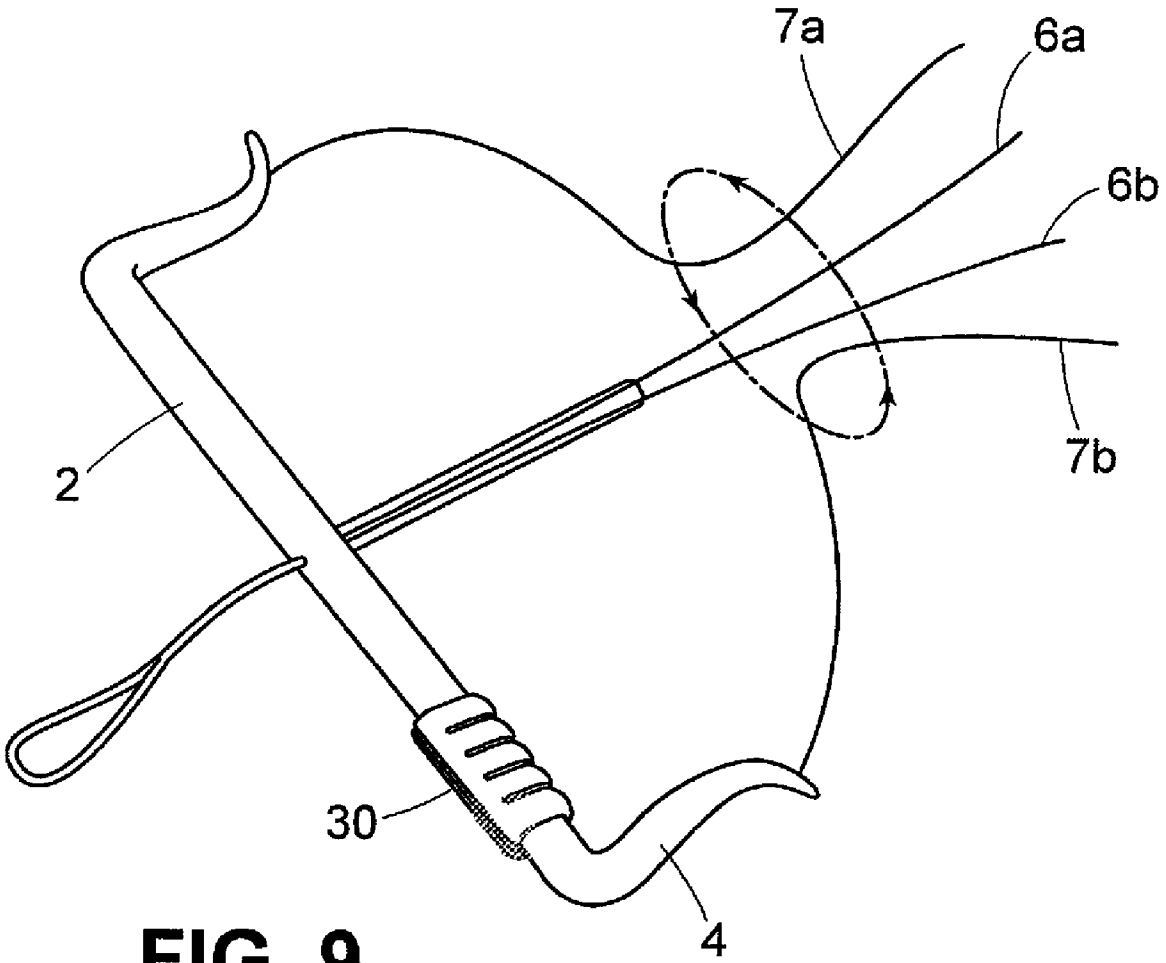
FIG. 9 is a view of FIG. 7 showing kite lines being wrapped around fingers of a control bar.
Figure 11:
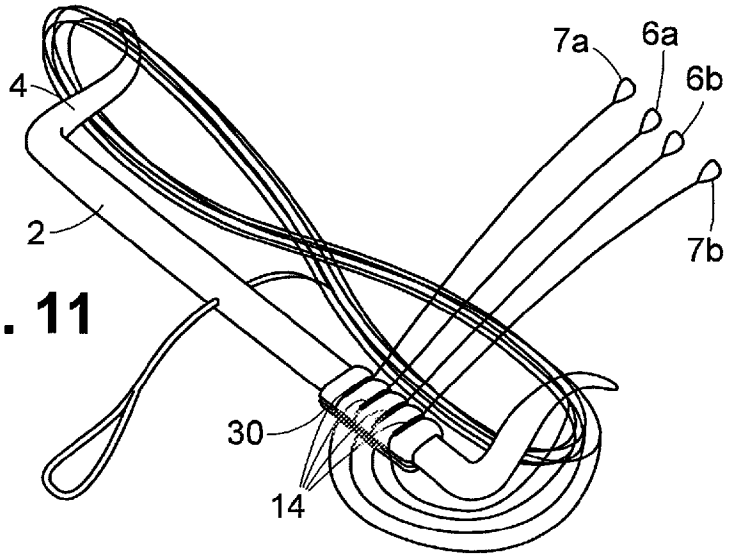
FIG. 11 is a perspective view showing the second embodiment of a device of the invention attached to a control bar, whereby a kite connected to the control bar.
Figure 10:
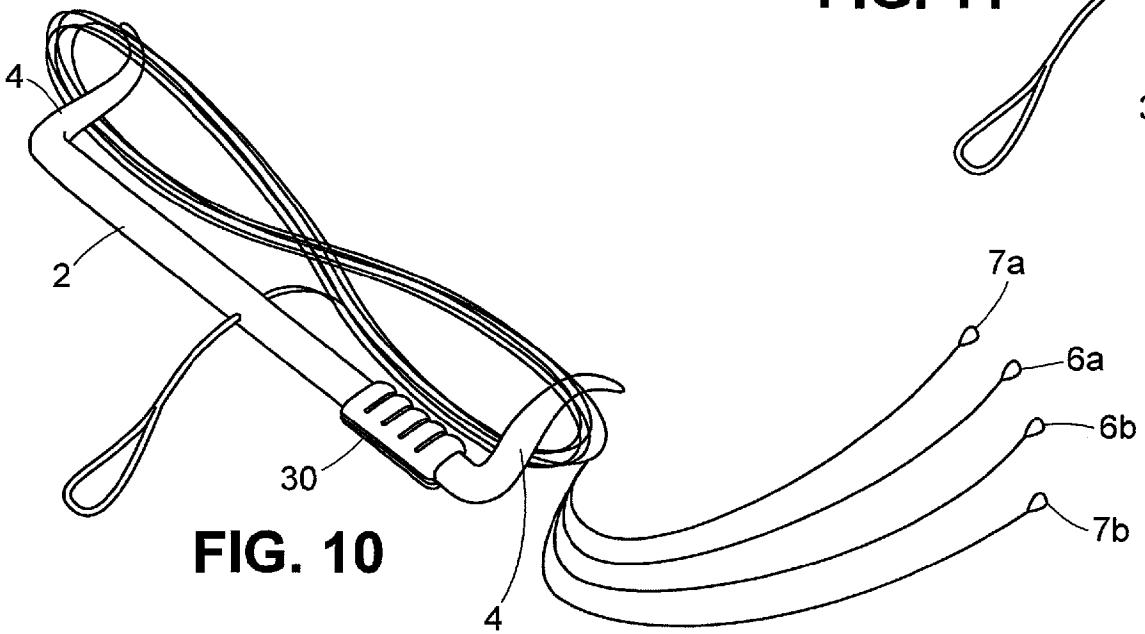
FIG. 10 is a view of FIG. 7 showing kite lines secured to a device of the invention.

FIGS. 8-10 show a similar method when using a second embodiment of the device. The lines (6*a*, 6*b*, 7*a*, 7*b*) of the kite are gathered (FIG. 8), and wrapped at least once around the fingers 4 of the control bar 2, preferably in a figure eight fashion (FIG. 9). The lines are then secured to the device as shown in FIG. 10. FIG. 11, which is not drawn to scale, shows the device 30 attached to a control bar 2, whereby a kite 22 is attached to the control bar by lines 6*a*, 6*b*, 7*a* and 7*b*.

The line attachment portion has slits or slotted grooves 14, preferably at least four in number, or otherwise corresponding to the number of lines of the kite. The grooves 14 allow the kite lines to be secured down, by frictional retention therein, preventing the lines from detaching at their ends during connection to the kite. However, the lines are also readily withdrawn from the grooves upon a purposeful tug by the user. The grooves also serve as a reference for the kite pilot to connect the lines to the kite prior to unrolling the lines from the control bar. The surface of the line attachment portion is preferably formed of a deformable rubber which can grasp-ingly retain kite lines being pushed into a groove therein. The slits may a simple circumferential cut in the outer surface of the sleeve, or may be in the form of slotted grooves which have a generally V-shaped profile for guiding the line into a retaining slot at the bottom thereof. A rubber elastomer of the type sold as Santoprene® is preferable.

In practice, the invention of is utilized as follows:

A. Loading the control bar with the lines:

1. Lines should be unrolled and uncrossed and laid out as if ready for kite attachment. Alternatively, the lines should be uncrossed and untangled but can still be attached to the kite.
2. Gather the lines close to the bar-end of the kite. This forms a triangle. See FIG. 3. The base of the triangle is the bar; each side of the triangle is the trailing edge line 7*a*, 7*b* origin. Note that the sides of the triangle will be shorter than the length of the bar 2, preventing the bar from looping through the lines when the "gather point" is attached to the middle of the bar by wrapping about the stem 32. For the second embodiment which has no stem, the user proceeds directly to the figure eight wraps of step 3 below.
3. Attached the gathered lines 6*a*, 6*b*, 7*a*, 7*b* to the device 32 by wrapping at least once around the stem 36. Now with the gathered point on the lines secured to the bar via the device, the pilot can begin rolling the lines on the bar in figure eight wraps. It is important to roll the lines in this figure eight manner in order to prevent the lines crossing over each other near the end of the lines (kite end).
4. As the lines are rolled in this figure eight, you begin to come close to the line ends. Decide on how much line you require to be left for the next time you attach you kite. This is determined by the span of the kite. For example, a 14 meter kite may require at least 4 meters of line. Now, attach the lines into the appropriate slots 14 on the line attachment portion 38. Preferably, the right trailing edge line 7*a*, 6*a* and right leading edge line are secured on the right side and the left leading edge 6*b* and left trailing edge line 7*b* on the left side of the portion 38.
5. Ensure that the lines are uncrossed and untangled when performing step 4 above.
6. The bar is now loaded with the lines in such a way that the will not be crossed over or tangled when connecting the kite to the line ends before unrolling from the bar.

B. Deployment:

1. Unroll the lines off the control bar only as far as the slots in which they are held.
2. Untangle this section of line that you have unrolled, and attach appropriately to the kite attachment points.
3. You can now detach the lines from the attachment slots 14.
4. You can keep unrolling the lines off the bar.
5. Lastly, unwind the gathering point of lines from the stem 36.
6. You are ready to launch.
7. After launch, the device 30 can be optionally detached while the kite is in use.

What is claimed is:

1. A device for managing lines of a kite, wherein during use the lines of the kite connect the kite to a control bar that is remote with respect to the kite, the device comprising:

means for securing the device to the control bar of the kite, wherein the means for securing the device has a longitudinal opening extending along a length of the means for securing the device, wherein during use the longitudinal opening radially receives a length of the control bar and is shaped to retain the length of the control bar within the longitudinal opening, wherein during use the means for securing the device grasps the control bar when inserted into the longitudinal opening; and a line attachment portion of the device connected to the means for securing the device, the line attachment portion comprising a plurality of means for detachably retaining the lines of the kite, wherein each means for detachably retaining the lines is adapted to detachably retain a single line of the kite.

2. The device according to claim 1, wherein the means for securing is an internally cylindrical sleeve at least along a portion thereof, said sleeve comprising the longitudinal opening adapted for radial insertion and retention of a control bar therein.

3. The device according to claim 2, wherein opposing portions of the sleeve adjacent the longitudinal opening are formed as fingers biased towards each other, are elastically flexible, and adapted to radially receive the control bar and are sufficiently rigid to frictionally retain the control bar once inserted.

4. The device according to claim 2, wherein the means for detachably retaining the line of a kite is formed as a slit or slotted groove in a circumferential direction with respect to the sleeve, which slit is formed to frictionally and removably retain the line of a kite inserted therein.

5. The device according to claim 2, wherein the line attachment portion resides adjacent an outside surface of the sleeve.

6. The device according to claim 1, further comprising a stem extending radially from the means for securing the device, the line attachment portion residing at the distal end of said stem.

7. The device according to claim 6, wherein the line attachment portion is formed as a longitudinal member perpendicular to the stem.

8. The device according to claim 6, wherein the stem is of sufficient dimension to permit gathered kite lines to be wound around the stem during line storage.

9. The device according to claim 6, wherein the stem and line attachment portion are T-shaped.

10. The device according to claim 1, wherein the means for securing is formed to have an internally cylindrical sleeve at least along a portion thereof, said sleeve comprising the longitudinal opening, wherein opposing portions of the sleeve adjacent the longitudinal opening are biased towards each other, are elastically flexible and are adapted for radially inserting of the control bar into the longitudinal opening and frictionally retaining the control bar once inserted, the means for detachably retaining the lines is formed as a slit or slotted groove in a circumferential direction with respect to the sleeve, wherein the slit or slotted groove is adapted to frictionally and removably retain the line inserted therein.

11. The device according to claim 10, wherein the control bar further comprises a stem extending radially from the means for securing, wherein the line attachment portion residing at the distal end of said stem, and further wherein the line attachment portion is formed as a longitudinal member perpendicular to the stem.

12. The device according to claim 1, wherein the device releasably secured to the control bar.

13. The device according to claim 1, wherein the means for securing the device to the control bar of a kite comprises a sleeve for engaging the control bar wherein the sleeve has a longitudinal internal aperture which at least in part conforms to an outer shape of a portion of the control bar to which it is secured.

14. The device according to claim 1, wherein the line attachment portion of the device is arranged on the means for securing the device to a control bar of a kite and comprises a plurality of slits or slotted grooves in a circumferential direction with respect to the means for securing the device.

15. The device according to 14, wherein the plurality of slits or grooves extends circumferentially around less than an entire circumference of the control bar or an entire circumference of the line attachment portion.

16. A device for managing lines of a kite, wherein during use the lines of the kite connect the kite to a control bar that is remote with respect to the kite, the device comprising:

means for securing the device to the control bar of the kite, wherein the means for securing the device has a longitudinal opening located between opposing free ends of the means for securing the device, wherein the longitudinal opening and the opposing free ends extend along a length of the means for securing, wherein during use and the opposing free ends receive a length of the control bar and retain the length of the control bar within the longitudinal opening; and a line attachment portion of the device connected to the means for securing the device, wherein the line attachment portion comprising means for detachably retaining the lines of the kite, wherein the means for detachably retaining the lines are formed in a circumferential direction with respect to the means for securing the device and along less than an entire circumference of the means for securing the device.

17. The device according to claim 16, wherein a lateral distance between the opposing free ends is less than a diameter of the control bar.

* * * * *